United States Patent [19]

Kroener

[11] Patent Number: 4,704,710

[45] Date of Patent: Nov. 3, 1987

[54] ARRANGEMENT FOR ADJUSTING THE HAND POSITION OF A WATCH

[75] Inventor: Wolfgang Kroener, Pforzheim, Fed. Rep. of Germany

[73] Assignee: Pforzheimer Uhren-Rehwerke PORTA G.m.b.H., Pforzheim, Fed. Rep. of Germany

[21] Appl. No.: 807,344

[22] Filed: Dec. 10, 1985

[30] Foreign Application Priority Data

Dec. 10, 1984 [DE] Fed. Rep. of Germany ... 8436090[U]

[51] Int. Cl.[4] ..... G04B 17/12; G04B 27/02

[52] U.S. Cl. ..... 368/185; 368/190; 368/195

[58] Field of Search ..... 368/69, 184–185, 368/190–194, 196–199, 319–321

[56] References Cited

U.S. PATENT DOCUMENTS

| | | | |
|---|---|---|---|
| 3,871,169 | 3/1975 | Schwaar et al. | 368/195 |
| 4,104,866 | 8/1978 | Chappatte | 368/319 |

FOREIGN PATENT DOCUMENTS

| | | | |
|---|---|---|---|
| 367762 | 4/1963 | Switzerland | 368/190 |
| 642220 | 4/1984 | Switzerland | 368/185 |

*Primary Examiner*—Vit W. Miska

[57] ABSTRACT

A timepiece hand adjustment mechanism especially for small wristwatches comprises a control shaft with a squared key structure formed thereon and a coupling lever operating member with squared central passage disposed on the key structure so as to be movable therewith. The coupling lever operating member has a collar of which a section projects into an elongated opening in a coupling operating lever so that the lever can be pivoted by axial movement of the control shaft for coupling the adjustment mechanism while, at the same time, it can be rotated for adjusting the hand position.

2 Claims, 5 Drawing Figures

ARRANGEMENT FOR ADJUSTING THE HAND POSITION OF A WATCH

BACKGROUND OF THE INVENTION

The invention relates to an arrangement for adjusting the positions of the hands of a timepiece, especially a wristwatch, which includes a hand position setting shaft carrying for rotation therwith a coupling drive and a coupling drive lever in engagement with the coupling drive.

A watch including such a hand position adjustment mechanism is well-known in the prior art.

In such hand position adjusting arrangements the position setting control shaft is generally coupled with the hand drive mechanism by outward pulling of the control shaft. Pressing the control shaft back into the housing causes again disengagement of the control shaft from the hand drive mechanism. Such arrangements have proved to be not only reliable but all watch owners are familiar with such mechanisms and like them.

In present watch adjustment mechanisms a coupling operation member is mounted on the control shaft for rotation therewith and is provided with a circumferential groove into which a portion of a coupling operating lever projects directly or into which a pin mounted on the coupling operating lever projects for operation of the lever by axial movement of the control shaft. Such a design is generally quite sturdy and can withstand the sometimes rough handling thereof by the user of a watch. It requires however a relatively large amount of space since the coupling operating member surrounds the control shaft and is provided with such a groove so that the operating member needs to have a relatively large diameter to provide sufficient material at the bottom of the groove for the square passage within. If, on the other hand, the groove is formed at the end of the adjustment shaft where it could be formed in a section without passage if the passage were formed as a blind hole, then the shaft and coupling operating member become relatively long. It is also noted that the manufacture of such small parts with blind holes for mounting the part on the control shaft is extremely difficult particularly since the cross-sectional area of the blind hole needs to be out of round.

In the process of miniaturizing the water mechanisms it is becoming quite difficult to accommodate the present adjustment structures, so much that, in some cases, the given mechanisms have been omitted and replaced by separate adjustment buttons which however have encountered opposition by the watch buyers.

It is therefore the principal object of the present invention to provide a watch adjustment mechanism of the type described which is as sturdy and as easy to manufacture as the prior art arrangements but which, in contrast, occupies substantially less space.

SUMMARY OF THE INVENTION

In a hand position adjustment mechanism for a wristwatch with a single control shaft having a squared key structure formed thereon and a coupling lever operating member with squared control passage disposed thereon for movement with the control shaft and for operating a coupling operating lever for coupling the adjusting mechanism while, at the same time, the control shaft may be rotated for adjusting the position of the watch's hands, the coupling lever operating member has a collar formed thereon and the coupling operating lever has an elongated opening into which a section of the collar projects to permit pivoting of the coupling operating lever by axial movement of the control shaft.

Preferably, the elongated opening is formed by wall edges which are curved and project into the opening so as to roll off on the collar's side faces to facilitate operation of the lever.

In this arrangement the coupling operating lever is not received in a groove in the coupling lever operating member but the coupling lever operating member is of relatively small diameter and provided with a collar which projects into a cut-out in the coupling operating lever. Although this would appear to be simply a reversal of the prior art principle, such reverse arrangement provides for substantial benefits.

First, the arrangement provides for the desired reduction in volume of the position changing structure since, generally, the diameter of the lever operating member needs to be only large enough to provide sufficient stability for its function. No more material is needed to permit cutting of the grooves into the member. Instead the member is provided with a collar which, although projecting radially, is only relatively short and requires substantially less volume than an arrangement with a groove. Also, the coupling operating lever is flat without any projection entering a groove, it may be disposed as a whole much closer to the axis of the lever operating member and, finally, it is not subjected to twisting forces and may therefore be small and thin such that it can easily fit into the watch drive mechanism.

Second, the engagement structure for the collar is simply an elongated hole punched in the coupling operating lever which hole receives a section of the collar. The edges of the lever defining the hole are punched in a curved fashion such that they roll on the side walls of the collar when the lever is operated which provides for a kinetically well defined and therefore easily operable arrangement.

Finally, all the parts involved are not only less complicated but also much easier to manufacture and especially suitable for automatic manufacturing. This is especially true when the square guiding structure receiving the operating member is disposed at the end of the control shaft.

SHORT DESCRIPTION OF THE DRAWINGS

FIG. 1 shows a watch hand position changing operating mechanism in assembled form, FIG. 2 shows a coupling operating lever, FIG. 3 shows a control shaft, FIG. 4 shows a coupling lever operating member, and FIG. 5 is an axial view of the coupling lever operating member of FIG. 4.

DESCRIPTION OF A PREFERRED EMBODIMENT

Figure 2:
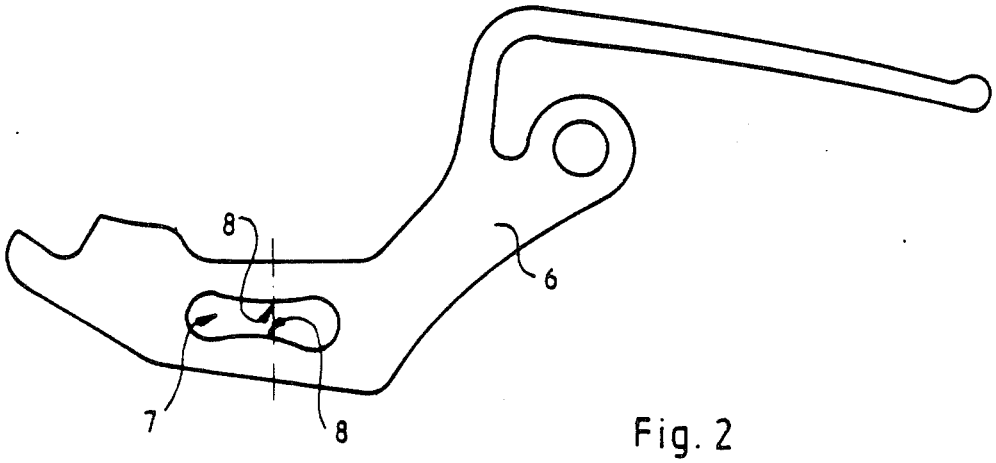
Figure 1:
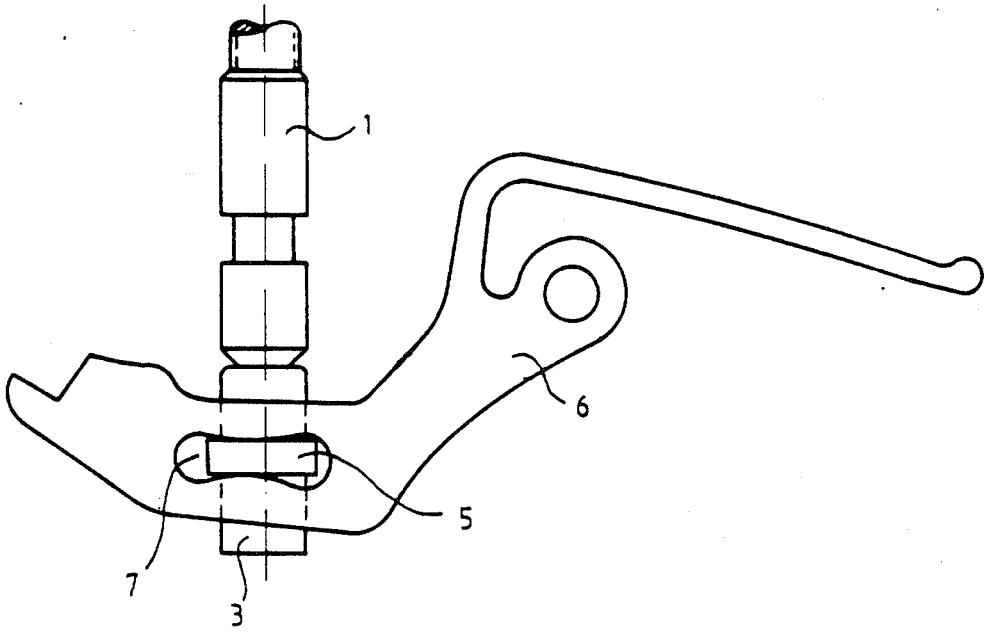
Figure 3:
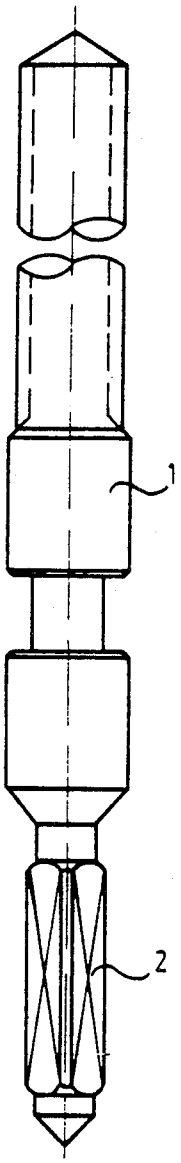
Figure 5:
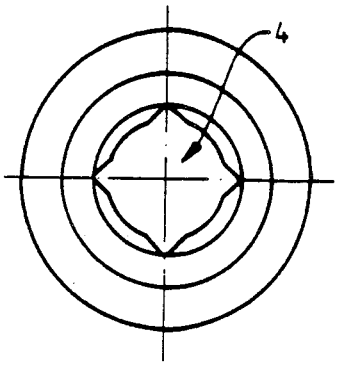
Figure 4:
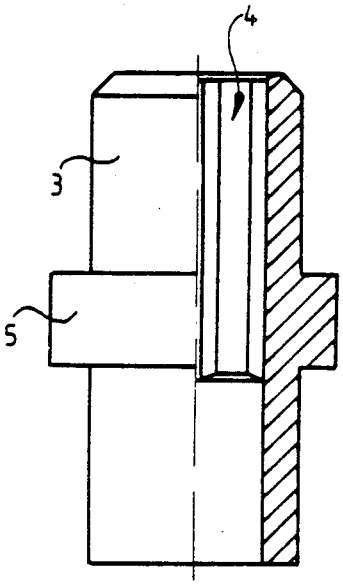

As shown in FIGS. 1 and 3, a watch hand position control shaft 1 is provided at its end with a squared guide structure 2 on which there is disposed a coupling lever operating member 3 which is provided with a central squared hole 4 (FIG. 4) corresonding to the squared guide structure 2 of the control shaft 1. About in its axial center the operating member 3 is provided with a collar 5 of essentially rectangular cross-section. As shown in FIG. 2 the coupling operating lever 6 is provided with an elongated hole 7 which is stamped in and has opposite curved wall edges 8 which project toward each other into the center of the hole.

FIG. 1 presents the parts assembled showing the lever operating member 3 disposed with its squared center passage on the squared guide structure 2 of the adjustment shaft 1 and the collar 5 of the operating member 3 projecting into the elongated hole 7 in the coupling operating lever 6. The curvature of the side edges 8 of the elongated hole 7 with coupling operating lever 6 provides for kinetically correct conditions upon pulling the control shaft 1 out or pushing it in for pivoting the coupling operating lever 6.

I claim:

1. A timepiece hand adjustment mechanism especially for a wristwatch, comprising a control shaft having a squared key structure formed thereon, a coupling lever operating member having a squared central passage and being disposed on the key structure of said control shaft for movement therewith, said coupling lever operating member having a collar of rectangular axial cross-section extending therearound and a coupling operating lever having formed therein an elongated opening receiving a section of said collar so as to permit actuation of said operating lever by axial movement of said control shaft, said elongated opening in said coupling operating lever being formed between inwardly curved wall sections which provide for a roller cam structure to facilitate operation of said lever by axial movement of said control shaft.

2. An adjustment mechanism according to claim 1, wherein said squared key structure is arranged at one end of said control shaft.

* * * * *